US008858275B2

(12) United States Patent
Onuma et al.

(10) Patent No.: US 8,858,275 B2
(45) Date of Patent: Oct. 14, 2014

(54) CRIMP-STYLE TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/813,892

(22) PCT Filed: Jul. 28, 2011

(86) PCT No.: PCT/JP2011/067236
§ 371 (c)(1),
(2), (4) Date: Feb. 1, 2013

(87) PCT Pub. No.: WO2012/017907
PCT Pub. Date: Feb. 9, 2012

(65) Prior Publication Data

US 2013/0130565 A1 May 23, 2013

(30) Foreign Application Priority Data

Aug. 4, 2010 (JP) ..... 2010-175183

(51) Int. Cl.
*H01R 4/10* (2006.01)
*H01R 4/18* (2006.01)

(52) U.S. Cl.
CPC ..... *H01R 4/18* (2013.01); *H01R 4/184* (2013.01); *H01R 4/188* (2013.01); *H01R 4/185* (2013.01)
USPC ..... 439/877

(58) Field of Classification Search
CPC ..... H01R 4/184; H01R 4/183; H01R 4/2495; H01R 4/26
USPC ..... 439/877, 882
See application file for complete search history.

(56) References Cited

U.S. PATENT DOCUMENTS 4,003,623 A 1/1977 Reynolds
4,828,516 A * 5/1989 Shaffer ..... 439/877
(Continued)

FOREIGN PATENT DOCUMENTS

JP 51-080683 A 6/1976
JP 55-096575 A 7/1980
(Continued)

OTHER PUBLICATIONS

International Search Report dated Dec. 9, 2013, issued in European Patent Application No. 11814534.1.
(Continued)

*Primary Examiner* — Phuong Dinh
(74) *Attorney, Agent, or Firm* — Sughrue Mion, PLLC

(57) ABSTRACT

A crimp-style terminal (10) which includes a base plate (13); a conductor crimp unit (12) which is formed, to have a substantially U-shaped cross section, from a pair of conductor swage pieces (14) which extend to both sides of the base plate (13) and are swaged to encase conductors (Wa) of a wire (W), the wire being arranged on the inner surface of the base plate (13), and which is crimped and connected to the terminals of the conductors (Wa); and a plurality of serrations (16) which are on the inner surface of the conductor crimp unit (12) and which are formed from cylindrical concave sections having identical radii. The depth of the serrations (16) formed at the rear end-side inner surface of the conductor swage pieces (14) is shallower than that of the serrations (16) formed at the front end-side inner surface of the base plate (13).

3 Claims, 7 Drawing Sheets

(56) References Cited

U.S. PATENT DOCUMENTS

| | | | | |
|---|---|---|---|---|
| 6,056,605 | A * | 5/2000 | Nguyen et al. | 439/882 |
| 2003/0013353 | A1 | 1/2003 | Sakaguchi et al. | |
| 2011/0125247 | A1 * | 5/2011 | Farnan et al. | 623/1.11 |
| 2013/0115828 | A1 * | 5/2013 | Seifert et al. | 439/877 |

FOREIGN PATENT DOCUMENTS

| | | | |
|---|---|---|---|
| JP | 55-108192 | A | 8/1980 |
| JP | H02503726 | A | 11/1990 |
| JP | 10-125362 | A | 5/1998 |
| JP | 2003-031274 | A | 1/2003 |
| JP | 2009-245695 | A | 10/2009 |
| WO | WO 88/08625 | A1 | 11/1988 |

OTHER PUBLICATIONS

Notification of Reasons for Refusal dated Jul. 15, 2014, issued by the Japanese Patent Office in corresponding Application No. 2010-175183.

* cited by examiner (a)

(b)

(c)

CRIMP-STYLE TERMINAL

TECHNICAL FIELD

The present invention relates to a crimp-style terminal which is favorable in use for connection with an electric wire.

BACKGROUND ART

As a conventional crimp-style terminal, the one shown in FIG. 1 is known (for example, see Patent Literature 1). This crimp-style terminal 110 includes an electrical connection unit 111 which is electrically connectable with a not shown mating side terminal, a conductor crimp unit 112 which is almost U-shaped in section and crimped and connected to a conductor (a core wire) Wa formed by twisting together a plurality of element wires Wc of an electric wire W, and a coating swage unit 115 which is fixed to an insulating coating part Wb of the electric wire W. Three concave-grooved serrations 118 that extend in a direction orthogonal to a longitudinal direction of the conductor Wa are formed in an inner surface 112*a* of this conductor crimp unit 112.

Then, when the conductor Wa of the electric wire W is crimped to the conductor crimp unit 112 of the crimp-style terminal 110 by swaging, and the element wire Wc of the conductor Wa is squeezed into the concave-grooved serration 118 while being deformed, an oxide film on a surface of the element wire Wc of the conductor Wa is torn staring from a serration edge 117 which is an edge of the serration 118 to generate a new surface, and close contact is established between the new surface and the conductor crimp unit 112 of the crimp-style terminal 110, by which electrical connection is attained.

CITATION LIST

Patent Literature

[PTL 1]
Japanese Patent Laid-Open No. 2009-245695 (FIG. 1)
[PTL 2]
Japanese Patent Laid-Open No. Hei 10-125362 (FIG. 4)

SUMMARY OF INVENTION

Technical Problem

Incidentally, in the above prior art crimp-style terminal 110, a variation when the conductor of the electric wire is swaged to the crimp unit of the crimp-style terminal is large, and, for example, when a crimping force is not enough (the compressibility is too low), generation of the new surface is not sufficiently made and resistance of electrical connection between the crimp-style terminal and the oxide film of the electric wire becomes high and unstable. In addition, when the crimping force is too strong (the compressibility is too high), such a problem occurs that damage to the conductor is increased (the damage is liable to be increased, in particular, in case of a conductor in which fine element wires are twisted and bundled) and strength (a fixing force) of mechanical connection between the crimp-style terminal and the electric wire is low and is liable to be varied.

Thus, a configuration that circular serrations 116 formed from a plurality of cylindrical concave sections are arranged in series at equal internals as shown in FIG. 2 and FIG. 3 is being conceived as a substitution for the concave-grooved serrations 118. Since the serration edge length can be ensured by the circular serrations 116 as mentioned above better than by the concave-grooved serrations 118, generation of the new surface can be made without increasing the crimping force and hence the damage to the conductor can be reduced.

However, it is difficult even for the circular serrations 116 to suppress a variation when swaging the conductor of the electric wire to the crimp unit of the crimp-style terminal just by arranging them in series at equal intervals.

The present invention, in view of the above mentioned circumstances, has an object to provide a crimp-style terminal capable of reducing a variation in work of swaging the conductor of the electric wire to the crimp unit of the crimp-style terminal, capable of stabilizing the resistance of electrical connection low, and capable of stabilizing the strength of mechanical connection high.

Solution to Problem

In order to attain the above mentioned object, a first aspect of the present invention is a crimp-style terminal including the following: a conductor crimp unit formed into substantially a U-shape by a base plate and one pair of conductor swage pieces extended on both sides of the base plate and swaged so as to encase a conductor of an electric wire disposed on an inner surface of the base plate, and crimped and connected to a terminal of the conductor; a plurality of serrations formed from cylindrical concave sections having identical radii in an inner surface of the conductor crimp unit; an electrical connection unit integrally formed on a leading end of the base plate via a leading-end side coupling unit and electrically connected with a mating side terminal; and a coating swage unit integrally formed on a trailing end of the base plate via a trailing-end side coupling unit and swaging a part with coating of the electric wire, wherein in the above configuration, the depth of the serration formed in a trailing-end side inner surface of the conductor swage piece is set shallower than the depth of the serration formed in a leading-end side inner surface of the base plate.

A second aspect of the present invention depending from the first aspect lies in that in the crimp-style terminal, the depth of the serration formed in an inner surface of the conductor swage piece is set shallower than the depth of the serration formed in an inner surface of the base plate.

A third aspect of the present invention depending from the first aspect lies in that in the crimp-style terminal, the conductor crimp unit is formed from a leading-end side crimp unit positioned on the leading-end side, and a trailing-end side crimp unit positioned on the trailing-end side; and the depth of the serration formed in an inner surface of the trailing-end side crimp unit is set shallower than the depth of the serration formed in an inner surface of the leading-end side crimp unit.

Advantageous Effects of Invention

According to the present invention described in the above first aspect, there is a feature that when the conductor swage piece is swaged so as to encase the conductor of the electric wire, the conductor readily intrudes into the serration which is formed in the leading-end side inner surface of the base plate and the conductor hardly intrudes into the serration formed in the trailing-end side inner surface of the conductor swage piece under a load imposed on the conductor crimp unit. Thus, on the leading-end side of the base plate, the area of the new surface generated when the conductor intrudes into the serration is further widened to bring the conductor crimp unit into close contact with the new surface with no space by deepening the serration by the amount of readiness in intrusion of the conductor into the serration when swaged, by which it becomes possible to stabilize the electrical connection resistance low. In addition, on the trailing-end side of the conductor swage piece, since the conductor can intrude into the serration with no space by making the serration shallow by the amount of difficulty in intrusion of the conductor into the serration when swaged, generation and growth of an oxide film starting from the space is reduced, by which it becomes possible to stabilize the electrical connection resistance low.

According to the present invention described in the above second aspect, the area of the new surface generated when the conductor intrudes into the serration is further widened to bring the conductor crimp unit into close contact with the new surface with no space by deepening the serration in the base plate on which the load is readily imposed when swaging the conductor swage piece so as to encase the conductor, by which it becomes possible to stabilize the electrical connection resistance low. In addition, since the conductor can intrude into the serration with no space by making the serration shallow in the conductive swage piece on which the load is hardly imposed, generation and growth of the oxide film starting from the space is reduced, by which it becomes possible to stabilize the electrical connection resistance low.

According to the present invention described in the above third aspect, since the serration edge evenly crimps to the conductor owing to arrangement of the shallow serrations in the trailing-end side crimp unit, it becomes possible to sufficiently obtain mechanical connection strength while dispersing damage applied to respective element wires at the time of crimping.

In addition, since the deep serrations are arranged in the leading-end side crimp unit, the area of the new surface is widened at the time of crimping, by which the resistance of electrical connection between the conductor and the terminal can be stabilized further low.

BRIEF DESCRIPTION OF THE DRAWINGS

FIG. 8(*a*) shows the state that the conductor has intruded into a deep serration with no space. FIG. 8(*b*) shows the state that the conductor cannot fully intrude into the deep serration and a space has been formed. FIG. 8(*c*) shows the state that the conductor cannot fully intrude into the deep serration and a space has been formed.

BEST MODES FOR CARRYING OUT THE INVENTION

In the following, a first embodiment of the present invention will be described with reference to FIG. 4 to FIG. 8(*c*).

Figure 1:
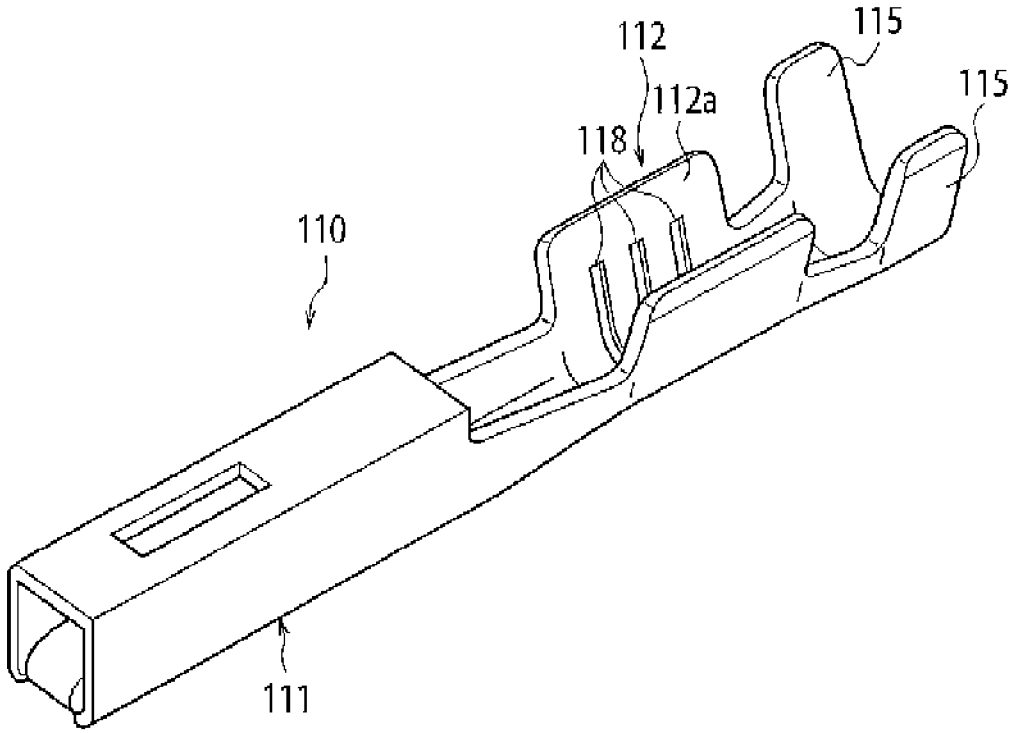
FIG. 1 PRIOR ART
FIG. 1 is a perspective view showing a conventional crimp-style terminal.
Figure 2:
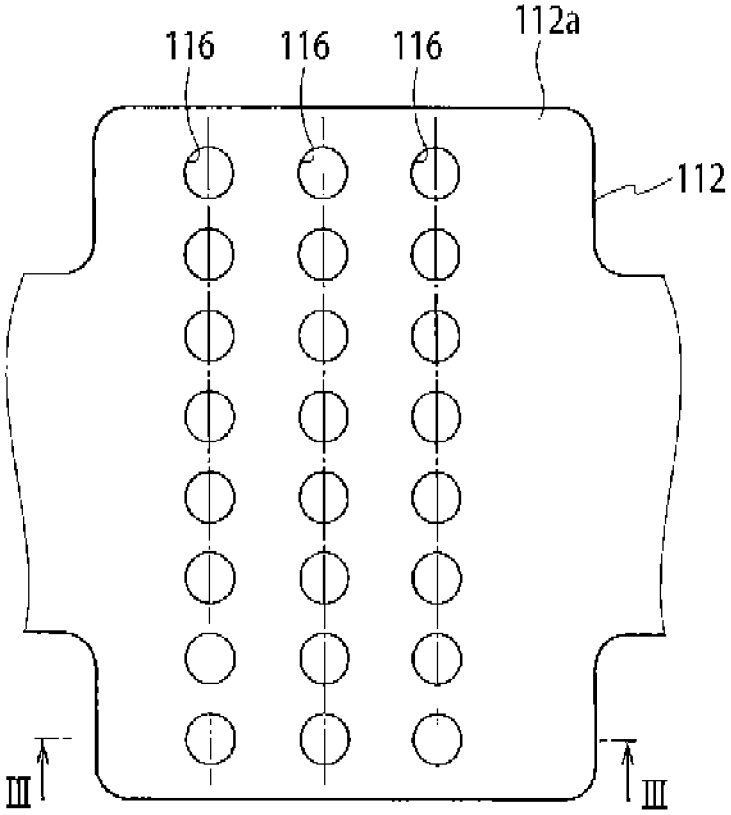
FIG. 2 PRIOR ART
FIG. 2 is an essential part development view showing a conductor crimp unit of the conventional crimp-style terminal.
Figure 3:
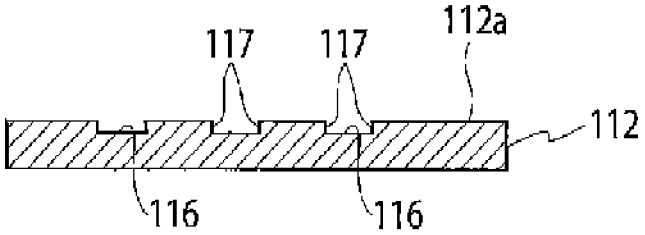
FIG. 3 PRIOR ART
FIG. 3 is a sectional view taken along a line in FIG. 2.
Figure 4:
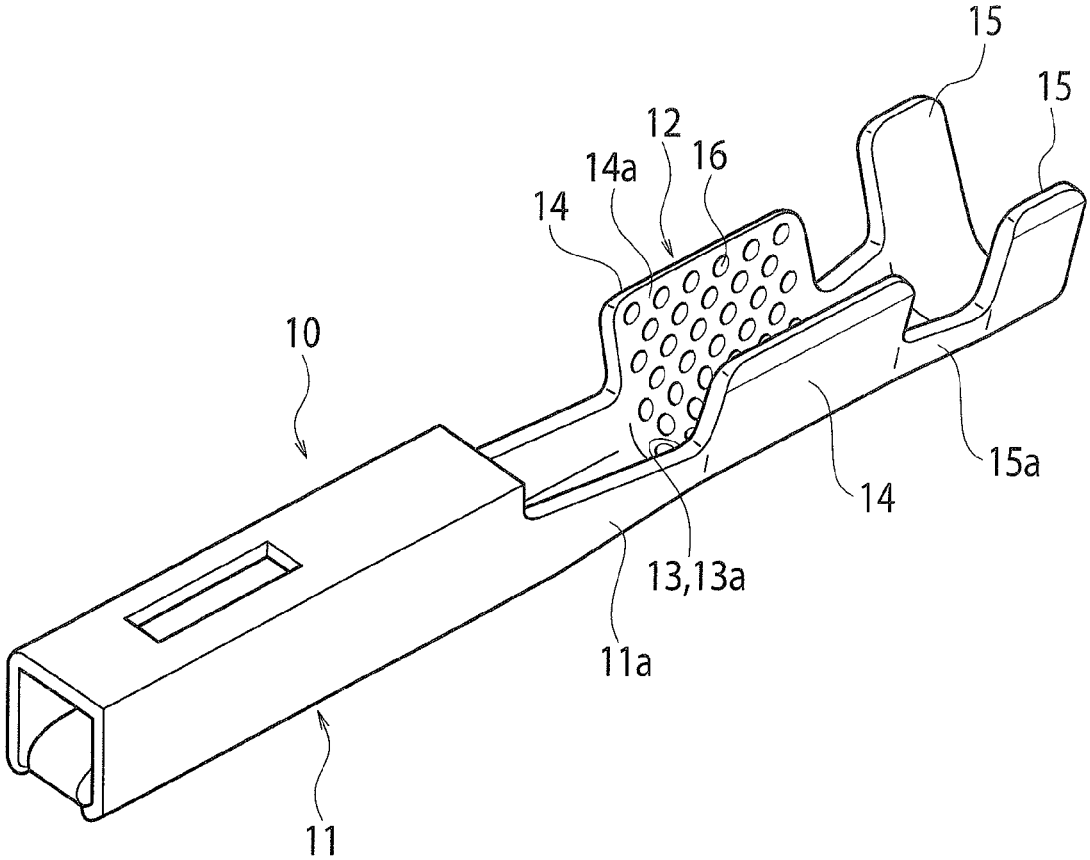
FIG. 4 is a perspective view showing a crimp-style terminal of a first embodiment of the present invention.
Figure 5:
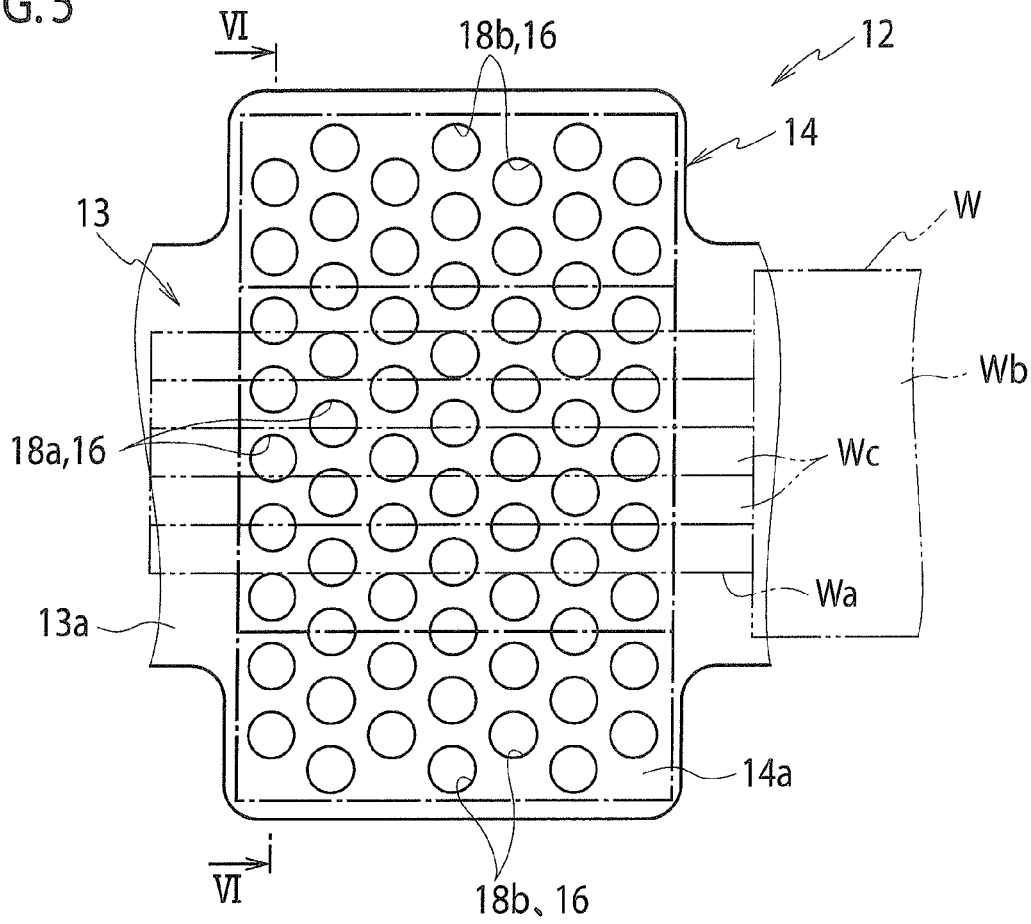
FIG. 5 is an essential part development view showing a conductor crimp unit of the crimp-style terminal of the first embodiment of the present invention.
Figure 6:
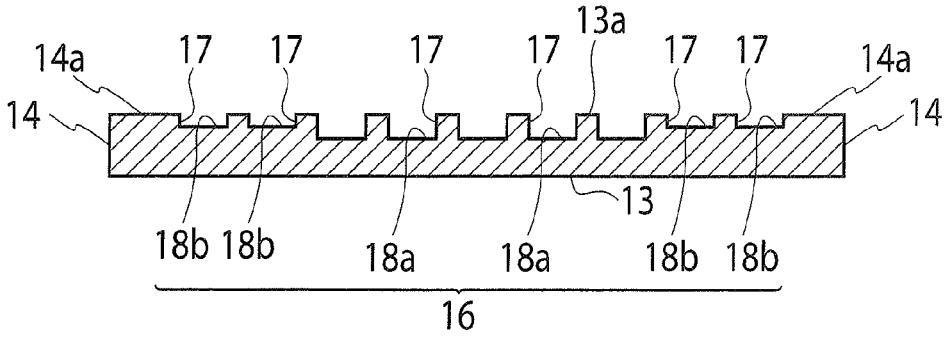
FIG. 6 is a sectional view taken along a VI-VI line in FIG. 5.

As shown in FIG. 4, this crimp-style terminal 10 is produced by press-working a copper or copper alloy plate which has been tinned in advance. In the crimp-style terminal 10, there are formed an electrical connection unit 11 to be electrically connected with a mating side terminal on a leading-end part, a conductor crimp unit 12 which will be wound on and crimped to an outer periphery of a terminal of a conductor Wa of an electric wire W to be electrically connected with the conductor Wa directly behind the electrical connection unit 11 via the leading-end side coupling unit 11*a*, and a coating swage unit 15 which will be wound on and swaged to an outer periphery of a part with coating of the electric wire W via a trailing-end side coupling unit 15*a* further on its rear side. That is, the electrical connection unit 11 is formed on the leading-end side of the conductor crimp unit 12 via the leading-end side coupling unit 11*a*, and the coating swage unit 15 is formed on the trailing-end side of the conductor crimp unit 12 via the trailing-end side coupling unit 15*a*.

The electric wire W is configured by the conductor (a core wire) Wa formed by twisting together a plurality of element wires Wc, and an insulating coating unit Wb that coats the conductor Wa. The crimp-style terminal 10 is connected to a terminal (a front end) of the conductor Wa of the electric wire W with its front-back direction in line with a longitudinal direction of the conductor Wa of the electric wire W.

The conductor crimp unit 12 is formed into substantially a U-shape by a base plate 13 which continues from the electrical connection unit 11, and one pair of left and right conductor swage pieces 14, 14 which are extended on both of the right and left sides of the base plate 13 and are swaged so as to encase the conductor Wa disposed on an inner surface 13*a* of the base plate 13.

Serrations 16 are regularly arranged at predetermined intervals in an inner surface of this conductor crimp unit 12, that is, in a range from the inner surface 13*a* of the base plate 13 to an inner surface 14*a* of the conductor swage piece 14. In addition, these serrations 16 are configured by base plate serrations 18*a* formed in the inner surface of the base plate 13 and swage piece serrations 18*b* formed in the inner surface of the conductor swage piece 14. Although the base plate serrations 18*a* and the swage piece serrations 18*b* are cylindrical concave sections having identical radii, the depth of the swage piece serration 18*b* is set to be shallower than the depth of the base plate serration 18*a*.

Figure 7:
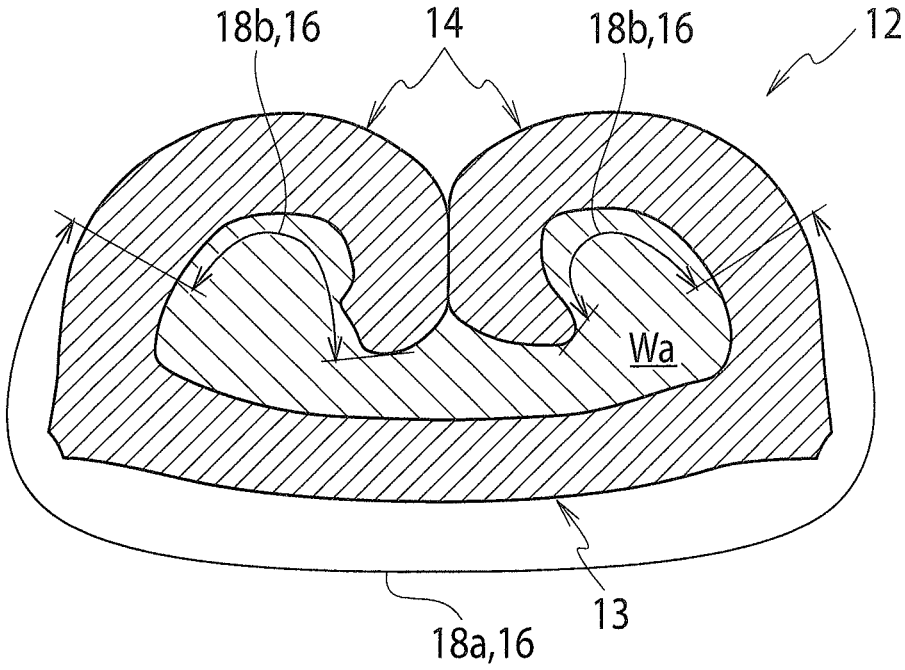
FIG. 7 is a sectional view showing a state that the conductor crimp unit of the first embodiment of the present invention has been swaged together with a conductor.
Figure 8:
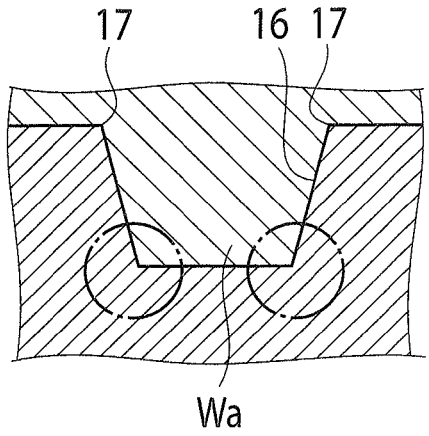
FIG. 8(*a*), FIG. 8(*b*), and FIG. 8(*c*) are essential part enlarged sectional view showing a state that the conductor has intruded into a serration when the conductor crimp unit of the first embodiment of the present invention has been swaged together with the conductor.
Figure 8:
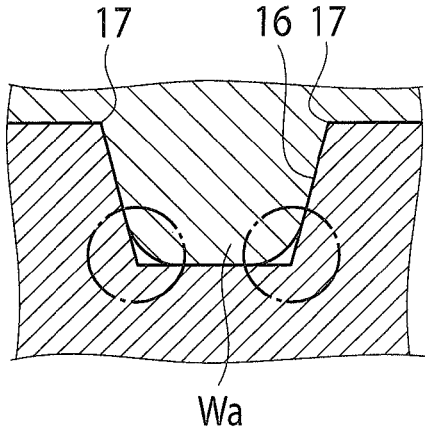
Figure 8:
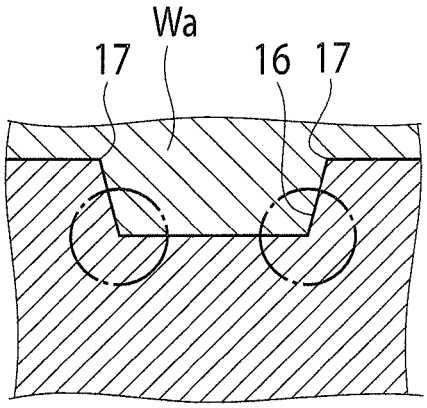

When the conductor Wa which has been exposed by peeling the terminal of the electric wire W is put on the base plate 13 of the conductor crimp unit 12 of the crimp-style terminal 10 thus configured and is crimped by swaging the one pair of conductor swage pieces 14, 14 so as to encase the conductor Wa as shown in FIG. 7, the inner surface of the conductor crimp unit 12 is strongly pressed into contact with the conductor Wa under the load imposed from the outside and the conductor Wa extends along the longitudinal direction between the serration 16 and the serration 16, and then a part of the conductor Wa is press-fitted into the serrations 16.

Then, when the part of the conductor Wa intrudes into the base plate serration 18*a*, the oxide film on the surface of the conductor Wa is broken by a serration edge 17 which is an opening edge of the serration 16, the new surface is exposed and the new surface is brought into close contact with the serration 16, by which it becomes possible to reduce the electrical connection resistance.

In addition, although the depth of the base plate serration 18*a* configuring the serration 16 is set deep, since the base plate serration 18*a* is formed in the base plate 13 on which the load is readily imposed, the part of the conductor Wa intrudes into the base plate serration 18*a* with no space. Therefore, since it never occurs that the oxide film is formed on the exposed new surface, it becomes possible to stabilize the electrical connection resistance still low.

Further, owing to deep intrusion of the part of the conductor Wa into the serration 16, the conductor Wa is caught on the serration edge 17, by which it becomes possible to increase the mechanical connection strength.

Therefore, an arrangement pattern of the serrations 16 of the present embodiment is suitable for a case that, for a conductor which is comparatively strong to mechanical damage, it is desired to reduce also the electrical connection resistance while further increasing the strength of mechanical connection between the conductor and the crimp-style terminal, as in cases that the conductor Wa is configured by a single lead wire and the wire diameter of each element wire Wc is comparatively thick even in the one in which the plurality of element wires Wc are twisted and bundled.

Figure 9:
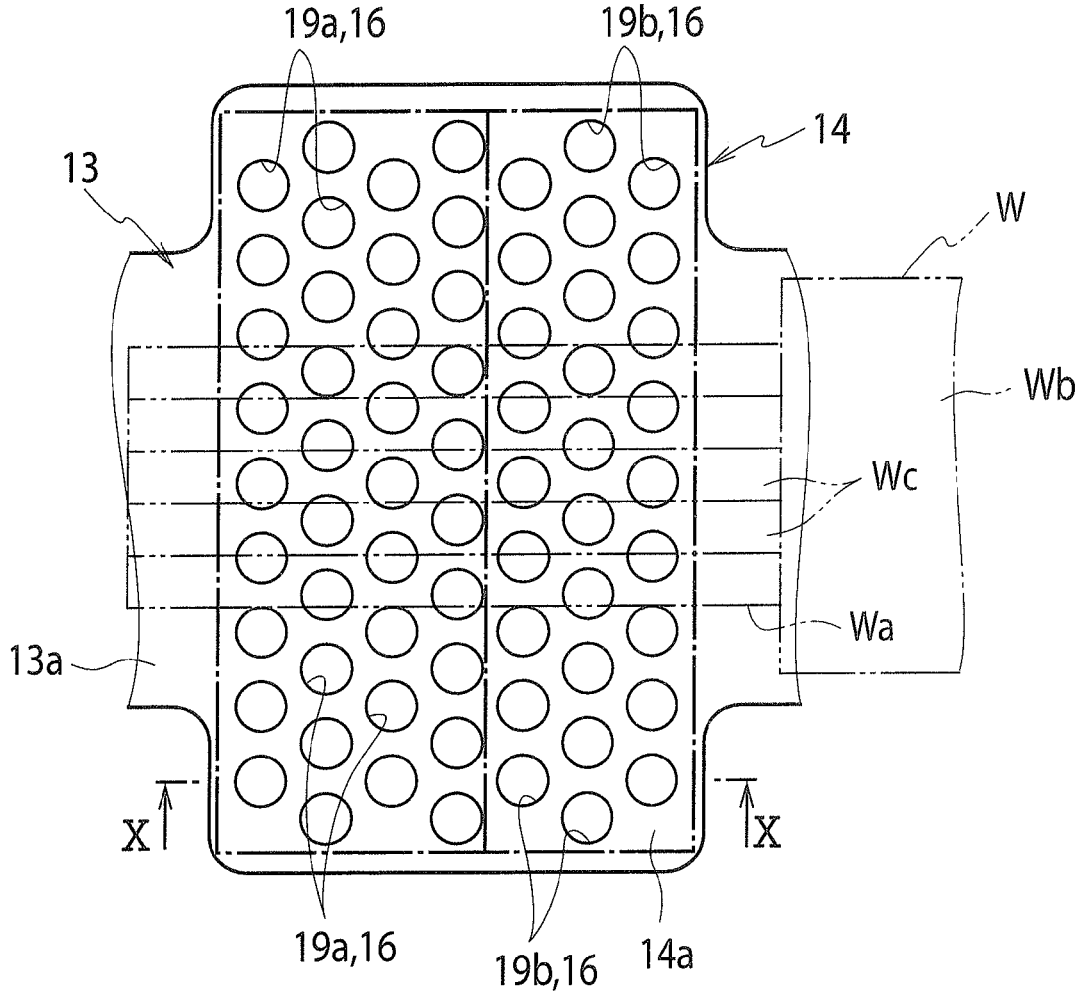
FIG. 9 is an essential part development view showing a conductor crimp unit of a crimp-style terminal of a second embodiment of the present invention.
Figure 10:
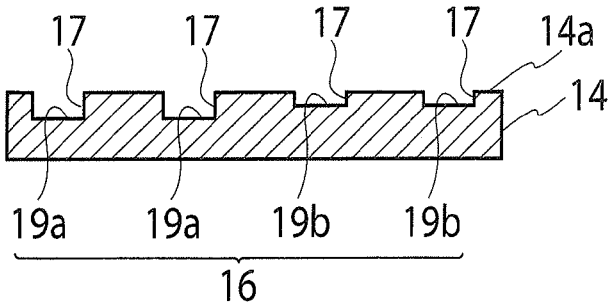
FIG. 10 is a sectional view taken along an X-X line in FIG. 9.

Next, the second embodiment of the present invention will be described with reference to FIG. 9 and FIG. 10. The same numerals are assigned to the same configurations as those in the first embodiment and detailed description thereof will be omitted. A difference in configuration between the present embodiment and the first embodiment lies in the arrangement pattern of the serrations 16 formed in the inner surface of the conductor crimp unit 12.

In the present embodiment, the conductor crimp unit 12 is configured by a leading-end side crimp unit 12*a* positioned on the leading-end side, and a trailing-end side crimp unit 12*b* positioned on the trailing-end side, and it is set such that the depth of a trailing-end side serration 19*b* to be formed in an inner surface of the trailing-end side crimp unit 12*b* is shallower than the depth of a leading-end side serration 19*a* to be formed in an inner surface of the leading-end side crimp unit 12*a*.

When a load is applied in a direction in which the electric wire W is drawn out from the crimp-style terminal 10, the load is greatly imposed on the trailing-end side of the conductor crimp unit 12. Therefore, in case of the conductor Wa in which the fine element wires Wc are twisted and bundled, when the serrations 16 which give a large damage to the conductor Wa are arranged in the trailing-end side crimp unit 12*b*, it is feared that the element wire Wc will be disconnected by the trailing-end side crimp unit 12*b*. Therefore, the trailing-end side serrations 19*b* of the shallow depth which give a little damage to the element wire Wc are arranged in the trailing-end side crimp unit 12*b* so as to satisfy the mechanical connection strength. In addition, when the load is applied in the direction in which the electric wire W is drawn out from the crimp-style terminal 10, the load is received by the trailing-end side crimp unit 12*b* and hence the possibility that the element wire Wc is disconnected by the leading-end side crimp unit 12*a* is small. Thus, the leading-end side serrations 19*a* which are deep in depth are arranged to stabilize the resistance of electrical connection between the conductor Wa and the crimp-style terminal 10 further low.

Therefore, it is the arrangement pattern of the serrations 16 with which the mechanical strength is made compatible with electrical connection resistance reduction when the crimp-style terminal is crimped to a conductor which is comparatively not strong to the mechanical damage such as the conductor Wa in which the fine element wires Wc are twisted and bundled.

Incidentally, it is possible to change the arrangement patterns of the leading-end side crimp unit 12*a* and the trailing-end side crimp unit 12*b* in accordance with the configuration of the conductor. For example, although the serrations 16 in the first embodiment and the second embodiment are formed to have two kinds of depths with the conductor crimp unit 12 divided into two regions, the base plate 13 and the conductor swage piece 14 may be divided into leading-end side ones and the trailing-end side ones, the conductor crimp unit 12 may be divided into four regions of a leading-end side base plate crimp unit (the leading-end side of the base plate 13), a trailing-end side base plate crimp unit (the trailing-end side of the base plate 13), a leading-end side swage crimp unit (the leading-end side of the conductor swage piece 14) and a trailing-end side swage crimp unit (the trailing-end side of the conductor swage piece 14), and the serrations may be formed to have such three kinds of depths that the serration in the leading-end side base plate crimp unit has a deep depth, the serration in the trailing-end side swage crimp unit has a shallow depth, and the serrations in the trailing-end side base plate crimp unit and the leading-end side swage crimp unit have depths in between the depths of the serrations in the leading-end side base plate crimp unit and the trailing-end side swage crimp unit.

Note that, Japanese Patent Application No. 2010-175183 (filed on Aug. 4, 2010) is hereby incorporated by reference herein in its entirety.

The present invention is not limited to the description of the above embodiment of the invention, and can be implemented in various other forms by making suitable modifications.

The invention claimed is:

1. A crimp-style terminal, comprising the following:

a conductor crimp unit formed into substantially a U-shape by a base plate and one pair of conductor swage pieces extended on both sides of the base plate and swaged so as to encase a conductor of an electric wire disposed on an inner surface of the base plate, and crimped and connected to a terminal of the conductor;

a plurality of serrations formed from cylindrical concave sections having identical radii in an inner surface of the conductor crimp unit;

an electrical connection unit integrally formed on a leading end of the base plate via a leading-end side coupling unit and electrically connected with a mating side terminal; and a coating swage unit integrally formed on a trailing end of the base plate via a trailing-end side coupling unit and swaging a part with coating of the electric wire, wherein in the above configuration, the depth of the serration formed in a trailing-end side inner surface of the conductor swage piece is set shallower than the depth of the serration formed in a leading-end side inner surface of the base plate.

2. The crimp-style terminal according to claim 1, wherein the depth of the serration formed in an inner surface of the conductor swage piece is set shallower than the depth of the serration formed in an inner surface of the base plate.

3. The crimp-style terminal according to claim 1, wherein the conductor crimp unit is formed from a leading-end side crimp unit positioned on the leading-end side, and a trailing-end side crimp unit positioned on the trailing-end side; and the depth of the serration formed in an inner surface of the trailing-end side crimp unit is set shallower than the depth of the serration formed in an inner surface of the leading-end side crimp unit.

* * * * *